US008469412B2

(12) United States Patent
Mizushima et al.

(10) Patent No.: US 8,469,412 B2
(45) Date of Patent: Jun. 25, 2013

(54) DOOR HANDLE DEVICE

(75) Inventors: Kenji Mizushima, Yokohama (JP); Toshikazu Kiso, Yokohama (JP); Mitsuo Nishizuka, Yokohama (JP)

(73) Assignee: Alpha Corporation, Yokohama-shi, Kanagawa (JP)

( * ) Notice: Subject to any disclaimer, the term of this patent is extended or adjusted under 35 U.S.C. 154(b) by 837 days.

(21) Appl. No.: 12/529,962

(22) PCT Filed: Mar. 7, 2008

(86) PCT No.: PCT/JP2008/054205

§ 371 (c)(1),
(2), (4) Date: Sep. 4, 2009

(87) PCT Pub. No.: WO2008/108472

PCT Pub. Date: Sep. 12, 2008

(65) Prior Publication Data

US 2010/0060019 A1 Mar. 11, 2010

(30) Foreign Application Priority Data

Mar. 7, 2007 (JP) ..... 2007-057671
Jan. 31, 2008 (JP) ..... 2008-021180

(51) Int. Cl.
*E05B 3/00* (2006.01)

(52) U.S. Cl.
USPC ..... 292/336.3

(58) Field of Classification Search
USPC ..... 292/336.3; 296/50; 16/110.1; 340/5.62, 340/5.72; 341/34
See application file for complete search history.

(56) References Cited

U.S. PATENT DOCUMENTS

| | | | | |
|---|---|---|---|---|
| 2,460,607 | A * | 2/1949 | Sullivan | 74/503 |
| 5,011,202 | A * | 4/1991 | Kato et al. | 292/336.3 |
| 5,613,717 | A * | 3/1997 | Ha | 292/336.3 |
| 5,794,994 | A * | 8/1998 | Miyagawa et al. | 292/336.3 |
| 6,431,643 | B2 * | 8/2002 | Grey | 296/214 |
| 6,626,473 | B1 * | 9/2003 | Klein et al. | 292/347 |
| 6,740,834 | B2 * | 5/2004 | Sueyoshi et al. | 200/600 |
| 6,976,717 | B2 * | 12/2005 | Barr et al. | 292/336.3 |

(Continued)

FOREIGN PATENT DOCUMENTS

| | | |
|---|---|---|
| CN | 1354815 A | 6/2002 |
| JP | 56-88849 | 7/1981 |

(Continued)

*Primary Examiner* — Thomas Beach
*Assistant Examiner* — Nathan Cumar
(74) *Attorney, Agent, or Firm* — Drinker Biddle & Reath LLP

(57) ABSTRACT

A door handle device is provided with: a door handle 9 by which the door of a vehicle can be opened and closed; a mounting bracket 11 for supporting the door handle 9 through a supporting shaft 15 so that the door handle can be swung in the back-and-forth direction with respect to the door 3 of the vehicle; and a switch unit 13, which is arranged between the door handle 9 and the mounting bracket 11, which generates an electric signal for locking and unlocking a door lock provided in the door of the vehicle. A contact portion (an engaging groove 27), with which the supporting shaft 15 comes into contact, is formed in the switch unit 13. When the supporting shaft 15 is inserted into a handle shaft insertion hole 9*b* and a bracket shaft insertion hole 11*a* so that the supporting shaft 15 can be engaged with the holes by an engaging grove 27, the switch unit is fixed to the mounting bracket.

10 Claims, 6 Drawing Sheets

U.S. PATENT DOCUMENTS

| | | | | |
|---|---|---|---|---|
| 7,062,945 | B2 | 6/2006 | Saitoh et al. | |
| 7,199,317 | B2 * | 4/2007 | Ieda et al. | 200/61.62 |
| 7,375,299 | B1 * | 5/2008 | Pudney | 200/61.62 |
| 7,819,442 | B2 * | 10/2010 | Ieda et al. | 292/336.3 |
| 7,866,714 | B2 * | 1/2011 | Monig et al. | 292/336.3 |
| 7,938,460 | B2 * | 5/2011 | Ishiguro | 292/336.3 |
| 8,136,853 | B2 * | 3/2012 | Ito | 292/336.3 |
| 2002/0046439 | A1 * | 4/2002 | Agostini et al. | 16/110.1 |
| 2003/0019261 | A1 * | 1/2003 | Wittwer | 70/257 |
| 2005/0230237 | A1 * | 10/2005 | Ieda et al. | 200/600 |
| 2010/0060019 | A1 * | 3/2010 | Mizushima et al. | 292/336.3 |

FOREIGN PATENT DOCUMENTS

| | | |
|---|---|---|
| JP | 60-98069 | 6/1985 |
| JP | 2002-531735 | 9/2002 |
| JP | 2003-221949 | 8/2003 |
| JP | 2004-169427 | 6/2004 |
| JP | 2005-76376 | 3/2005 |
| JP | 2005-90087 | 4/2005 |
| JP | 2005-330752 | 12/2005 |

* cited by examiner 3
15
11a
11
9b
17
6B
6B
19
42
11b
9a
13
7
42a
44
15a
17
43b
9
11a
9b
15

9
11
44a
11c
43b
44
45
43
43c
15
11b 15
44
11
7
3
42
9a
13
19
42a
9(9c)

9
41
9d
40
9b
3a
3
15
9c

DOOR HANDLE DEVICE

TECHNICAL FIELD

The present invention relates to a door handle device having a switch fixing structure for fixing a switch unit between a door handle and a mounting bracket.

BACKGROUND ART

There is a device in which a door lock arranged in a door of a vehicle is locked and unlocked by an electric means when a push button located at a predetermined position of a door handle arranged outside of the door of the vehicle is operated. Specifically, the device has a switch unit including, a push button which is arranged between the door handle and a mounting bracket and penetrates a button hole formed in the door handle so that the push button is exposed to the outside of the vehicle and displaced when a physical force is inputted to the push button from the outside, and a switch main body for forming an electric signal according to a displacement of the push button.

In this case, the switch main body is fixed to the mounting bracket by fixing members such as a screw and a bolt so that the button hole, which is formed in the door handle, and an outer circumference of the push button can agree with each other (refer to Patent Document 1, for example). Due to the above structure, when the door handle is pulled forward with respect to the vehicle door, it is possible to open and close the door. When the door handle is moved backward with respect to the vehicle door, that is, when the door handle is moved to a position where the door handle is automatically returned, it becomes possible to operate the push button penetrating the button hole formed in the door handle.

Patent Document 1: JP-A-2005-090087 (Pages 4 to 7 and FIG. 1)

However, in the above structure in which the switch unit is fixed to the mounting bracket (this structure will be referred to as a fixing structure hereinafter.), the switch unit (switch main body) is fixed to the mounting bracket by the fixing member. Therefore, the fixing member must be necessarily provided in this structure. Accordingly, it is demanded to reduce the number of parts.

In the conventional switch fixing structure, the switch unit must be mounted on the mounting bracket by the fixing member while positioning is being executed so that an outer circumference of the push button can be made to agree with the button hole formed in the door handle. Therefore, the assembling work of the door handle device becomes complicated and it is difficult to reduce working time.

In the door handle device described above, an escutcheon, which holds a door handle and is fixed to the door, is formed being exposed onto a door surface so that the escutcheon can surround the door handle. The switch unit is fixed while this escutcheon is being used as a mounting base portion.

That is, in the conventional example described above, the switch unit is arranged in the door handle device on the assumption that the escutcheon, which is a mounting base body, is used in the door handle device. Therefore, in the case where only the door handle is arranged without arranging the escutcheon round the door handle for the reasons of designing, it is necessary to directly fix the switch unit to the door.

However, in order to directly fix the switch unit to the door, it is necessary to form a mounting hole on a door panel. Further, the working property is not good when the switch unit is fixed to the door.

SUMMARY OF INVENTION

One or more embodiments of the present invention provide a switch fixing structure in which the number of parts can be reduced and further the work can be simplified so as to shorten the working time.

One or more embodiments of the present invention provide a handle device in which a switch unit can be arranged even in a case in which a holding base body is not exposed onto a door surface.

According to a first aspect of the present invention, a door handle device is provided with: a door handle, which is arranged outside a door of a vehicle, on a reverse side of which a handle shaft insertion hole into which a supporting shaft is inserted is formed, by which the door of the vehicle can be opened and closed; a mounting bracket, which is fixed to the door of the vehicle, in which a bracket shaft insertion hole into which the supporting shaft is inserted is formed, which supports the door handle through the supporting shaft so that the door handle can be swung in the back-and-forth direction with respect to the door of the vehicle; and a switch unit, which is arranged between the door handle and the mounting bracket, which generates an electric signal for locking and unlocking a door lock provided in the door of the vehicle. A contact portion, with which the supporting shaft comes into contact, is formed in the switch unit. The supporting shaft is inserted into the handle shaft insertion hole and the bracket shaft insertion hole and fixes the switch unit to the mounting bracket in the contact portion.

According to the aspect described above, in the contact portion, the supporting shaft fixes the switch unit to the mounting bracket. Therefore, the switch unit can be mounted on the mounting bracket without using fixing members such as a screw and a bolt. Accordingly, the number of parts can be reduced and the work can be simplified and the working time can be shortened.

According to a second aspect of the present invention, the switch unit may include a push button which is exposed outside the vehicle and displaced when a physical input is given to the push button from the outside of the vehicle and also include a switch main body which generates an electric signal according to a displacement of the push button. The contact portion may be an engaging groove which is arranged on a side of the switch main body and engaged with the supporting shaft. The switch unit may be fixed to the mounting bracket when the supporting shaft is engaged in the engaging groove.

According to the second aspect described above, when the supporting shaft is engaged in the engaging groove, the switch unit is fixed to the mounting bracket. Therefore, the switch unit can be positively mounted on the mounting bracket. Further, the door handle can be smoothly swung in the back-and-forth direction with respect to the door of the vehicle. Accordingly, the operability of the door handle can be ensured.

According to a third aspect of the present invention, the engaging groove may be provided on both sides of the switch main body. The supporting shaft may include a first supporting shaft engaging with one engaging groove and also include a second supporting shaft engaging with the other engaging groove.

According to the third aspect described above, the first and the second supporting shaft are engaged in the engaging grooves from both sides of the switch main body. Therefore, the door handle can be more smoothly swung in the back-and-forth direction with respect to the door of the vehicle. Accordingly, the operability of the door handle can be improved.

According to a fourth aspect of the present invention, the switch unit may include a push button which is exposed outside the vehicle and displaced when a physical input is given to the push button from the outside of the vehicle and also include a switch main body which generates an electric signal according to a displacement of the push button. The contact portion may be a through-hole into which the supporting shaft penetrates from one side of the switch main body to the other side. The switch unit may be fixed to the mounting bracket when the supporting shaft penetrates in the through-hole.

According to the fourth aspect described above, when the supporting shaft penetrates in the through-hole, the switch unit is fixed to the mounting bracket. Accordingly, the switch unit can be positively mounted on the mounting bracket and the door handle can be smoothly swung in the back-and-forth direction with respect to the door of the vehicle. Therefore, the operability of the door handle can be ensured.

According to a fifth aspect of the present invention, a door handle device is provided with: a mounting bracket fixed at a door of a vehicle; and a door handle pivotally connected to the mounting bracket. The mounting bracket is covered by the door handle under the condition that the door handle device is fixed to the door. A switch exposure opening, which exposes an operation portion of a switch unit held by the mounting bracket and generating a signal for locking and unlocking a door lock provided in the door of the vehicle, is provided in the door handle. According to the fifth aspect described above, the mounting bracket arranged behind the door handle can be utilized as a mounting base body of the switch unit and the door handle can be utilized as a display portion. Therefore, it becomes unnecessary to directly fix the switch unit to the door. Accordingly, the working property of mounting can be enhanced.

The door handle can be composed in such a manner that the door handle is horizontally rotated under the condition that the door handle is fixed to the door. However, in the case where the door handle is composed so that it can be operated in the vertical direction, that is, in the case where the door handle is composed as a so-called pull-up type, the switch exposure opening can be arranged at a position where the switch exposure opening overlaps on the rotary central line of the door handle in the front view.

When the door handle is composed as described above, the hand touching space can be enlarged. Further, the switch unit can be prevented from being exposed outside at the time of turning the door handle.

In the case where the switch exposure opening is arranged at a substantially central position in a longitudinal direction of the door handle, the right and the left portion can be made to be the same design.

According to one or more embodiments of the present invention, it is possible to provide a switch fixing structure in which the number of parts is reduced and the work is simplified so that the working time can be shortened.

Even in the case where the bracket is covered by the door handle under the condition that the switch unit is fixed to the door, the switch unit can be arranged. Therefore, the degree of freedom of designing can be enhanced.

Other aspects and advantages of the invention will be apparent from the following description, the drawings and the claims.

BRIEF DESCRIPTION OF DRAWINGS

FIG. 5(*b*) is a rear view of a door handle device of the second exemplary embodiment.

FIG. 6(*b*) is a sectional view taken on line 6B-6B in FIG. 6(*a*). FIG. 6(*c*) is a sectional view taken on line 6C-6C in FIG. 5(*a*). FIG. 6(*d*) is a sectional view taken on line 6D-6D in FIG. 5(*a*).

DESCRIPTION OF THE REFERENCE NUMERALS AND SIGNS

Figure 1:
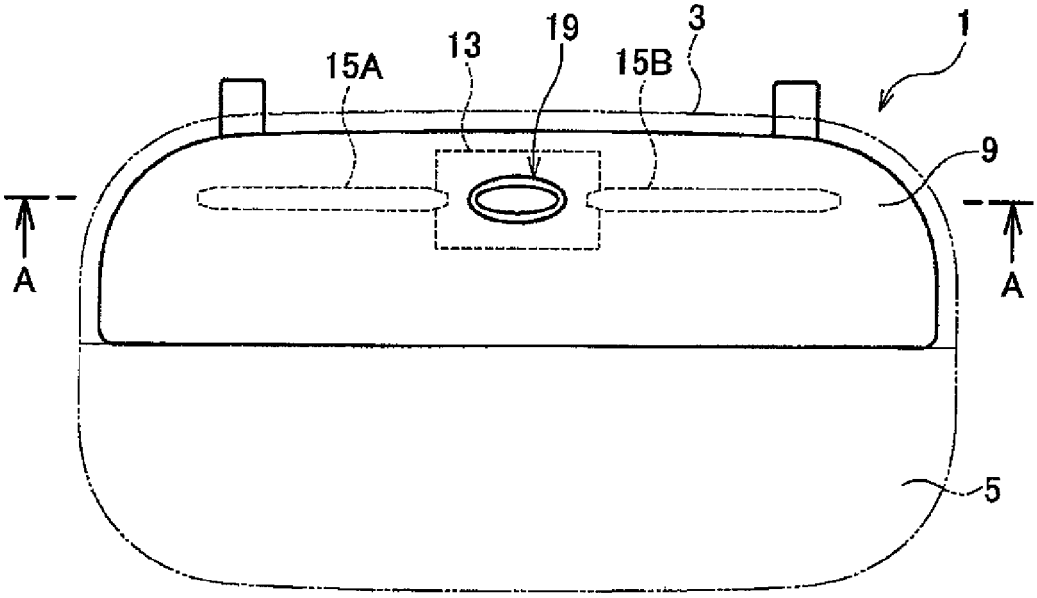
FIG. 1 is a front view showing a door handle device of the first exemplary embodiment.

1 . . . Door handle device
3 . . . Door of vehicle
5 . . . Recess portion
7 . . . Switch mounting hole
9 . . . Door handle
9*a* . . . Button hole
9*b* . . . Handle shaft insertion hole
9*c* . . . Hand touching portion
11 . . . Mounting bracket
11*a* . . . Bracket shaft insertion hole
13 . . . Switch unit
15 . . . Supporting shaft
15A . . . First supporting shaft
15B . . . Second supporting shaft
17 . . . Fixing member
19 . . . Push button
19A . . . Inside push button
19A . . . Inside push button
19B . . . Outside push button
19*a* . . . Input face
19*b* . . . Push operating portion
19*c* . . . Transmitting face
21 . . . Switch main body
23 . . . Base plate
25 . . . Harness
27 . . . Engaging groove
29 . . . Push nut
31 . . . Insertion groove
33 . . . Insertion protrusion
35 . . . Through-hole
42 . . . Switch holding hole
42*a* . . . Inward flange
45 . . . Member for preventing a shaft from slipping off

DESCRIPTION OF EMBODIMENTS

Referring to the drawings, examples of a door handle device of exemplary embodiments of the present invention will be explained below. In this connection, the same or similar reference marks are used to indicate the same or similar portions in the descriptions of the following drawings. However, the drawings are schematic. Therefore, it should be noted that ratios of the dimensions shown in the drawings are different from the actual values. Accordingly, the specific dimensions must be judged by giving considerations to the following explanations. Even the drawings contain portions, the ratios of the dimensions of which are different from each other.

<Constitution of Switch Fixing Structure>

Figure 2:
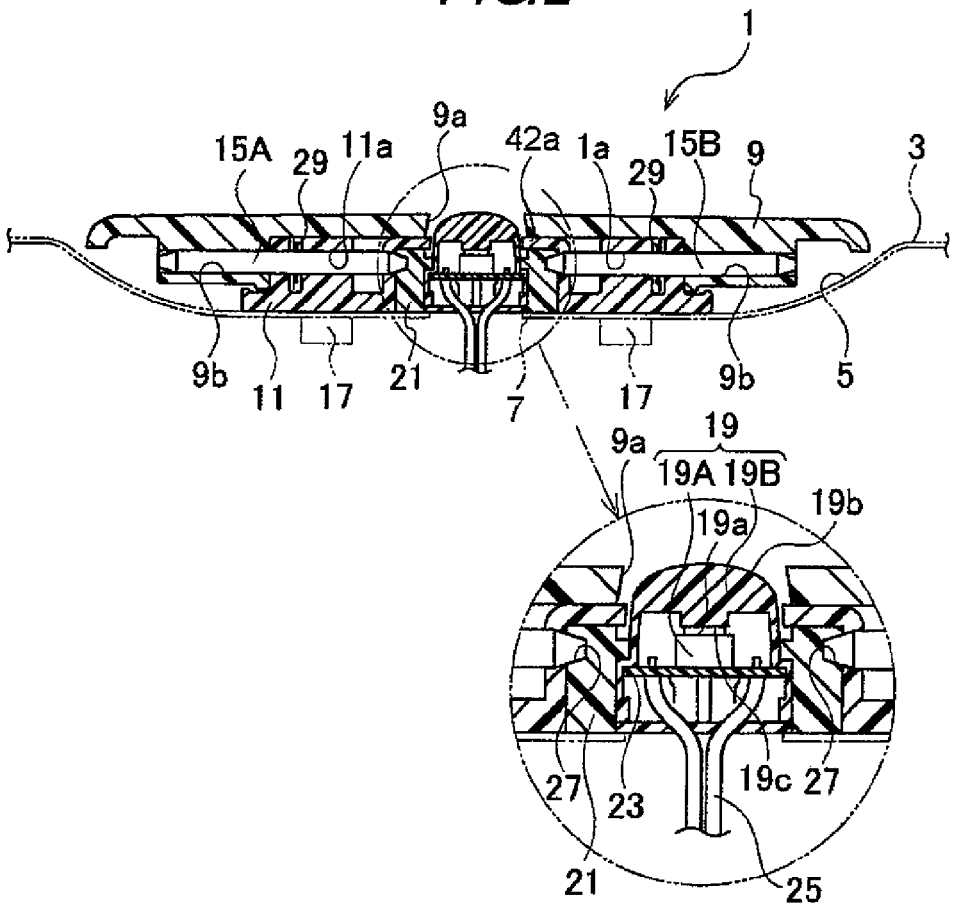
FIG. 2 is a sectional view (a sectional view taken on line A-A in FIG. 1) showing a door handle device of the first exemplary embodiment.
Figure 3:
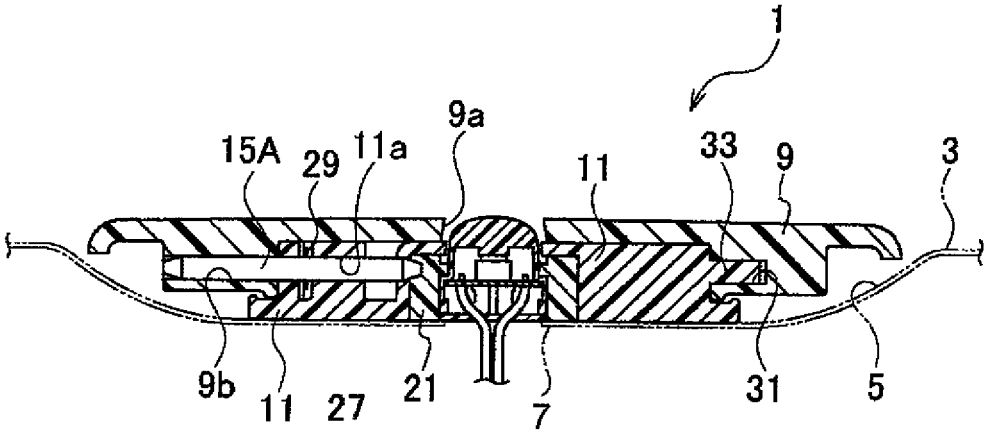
FIG. 3 is a sectional view showing a door handle device of Modification 1 of the first exemplary embodiment.

Referring to FIGS. 1 to 3, a constitution of a door handle device of a first exemplary embodiment of the present invention will be explained below. FIG. 1 is a front view showing the door handle device of the first exemplary embodiment of the present invention. FIG. 2 is a sectional view (a sectional view taken on line A-A in FIG. 1) showing the door handle device of the first exemplary embodiment. In this connection, the door handle device 1 locks and unlocks a door lock by an electric means.

As shown in FIGS. 1 and 2, the door handle device 1 is mounted on a switch mounting hole 7 formed on an upper side of a recess portion 5, which is recessed inside a vehicle, on a door 3 (the outer panel) of the vehicle. This door handle device 1 roughly includes: a door handle 9, a mounting bracket 11 and a switch unit 13.

The door handle 9 is provided outside the door 3 of the vehicle. The door 3 of the vehicle can be opened and closed by this door handle 9. In this door handle 9, a buttonhole 9*a*, in which a push button 19 composing a switch unit 13 described later penetrates, is formed. Inside (on the back side) the door handle 9, a handle shaft insertion hole 9*b*, which is a hole in which a support shaft 15 penetrates, is formed.

The mounting bracket 11 supports the door handle 9 through the supporting shaft 15 so that the door handle 9 can be swung in the back-and-forth direction with respect to the door 3 of the vehicle. This mounting bracket 11 is fixed to the door 3 of the vehicle. Outside the mounting bracket 11, a bracket insertion hole 11*a*, which is a hole into which the supporting shaft 15 is inserted, is formed.

This mounting bracket 11 is fixed to the door 3 of the vehicle with a fixing member 17 such as a bolt and a nut from the back side (the lower side in FIG. 2) of the door 3 of the vehicle.

The switch unit 13 is provided between the door handle 9 and the mounting bracket 11 and generates a signal for locking or unlocking a door lock provided on the door 3 of the vehicle. This switch unit 13 includes: the push button 19 which is exposed outside the vehicle and displaced when a physical input is given to it from the outside of the vehicle; and a switch main body 21 for forming an electric signal according to a displacement of the push button 19 concerned.

The push button 19 includes: an inside push button 19A protruding from a substantial center of the switch main body 21 to the outside of the vehicle; and an outside push button 19B covering the inside push button 19A from the outside of the vehicle.

The inside push button 19A has an input face 19*a* directed to the outside of the vehicle. When the input face 19*a* is given a physical input directed to the inside of the vehicle, the inside push button 19A is displaced in the direction of the inside of the vehicle with respect to the switch body 21, resisting a pushing force of the pushing means not shown in the drawing. By this displacement, a contact provided in the switch main body 21 generates an electric signal.

The outside push button 19B is composed so that it can penetrate the buttonhole 9*a* formed in the door handle 9. This outside push button 19B is made of material capable of being elastically deformed such as silicon rubber, rubber or resin. The outside push button 19B includes: a curved pushing operation portion 19*b*; and a transmitting face 19*c* directed from the back side of the pushing operation portion 19*b* to the inside of the vehicle. This transmitting face 19*c* comes into contact with or comes close to the input face of the inside pushbutton 19A.

The base board 23 for forming an electric signal and the harness 25, which is connected to a control means (not shown) of the vehicle, for outputting an electric signal are provided in the switch main body 21. On both sides of the switch main body 21, the contact portion coming into contact with the supporting shaft 15 is provided. In the present embodiment, the contact portion composes an engaging groove 27 with which the supporting shaft 15 is engaged.

The supporting shaft 15 is inserted into the shaft insertion hole 9*b* and the bracket shaft insertion hole 11*a* and fixes the switch unit 13 to the mounting bracket 11 in the engaging groove 27 (contact portion). This supporting shaft 15 includes: a first supporting shaft 15A engaged with one engaging groove 27; and a second supporting shaft 15B engaged with the other engaging groove 27.

When the first supporting shaft 15A and the second supporting shaft 15B are engaged with the engaging grooves 27, the switch unit 13 is fixed to the mounting bracket 11. In this connection, the supporting shaft 15 is fixed by the push nut 29 preventing the supporting shaft 15 from coming out.

According to the above constitution, when the door handle 9 is pulled forward with respect to the door 3 of the vehicle, the door 3 of the vehicle can be opened and closed. When the door handle 9 is moved backward, that is, when the door handle 9 is moved to a position to which the door handle is automatically returned with respect to the door 3 of the vehicle, the push button 19 (the outside push button 19B) penetrating in the buttonhole formed in the door handle 9 can be operated.

<Actions and Advantages>

According to the door handle device 1 of the first exemplary embodiment explained above, when the supporting shaft 15 fixes the switch unit 13 to the mounting bracket 11 through the contact portion, the switch, unit 13 can be mounted on the mounting bracket 11 without using fixing members such as screws and bolts. Therefore, the number of parts can be reduced and further the work can be simplified and the working time can be shortened.

Specifically, when the supporting shaft 15 is engaged with the engaging groove 27, the switch unit 13 is fixed to the mounting bracket 11. Due to the foregoing, the switch unit 13 can be positively mounted on the mounting bracket 11. Further, the door handle can be smoothly swung in the back-and-forth direction with respect to the door of the vehicle. Accordingly, the operability of the door handle 9 can be ensured.

Especially when the first supporting shaft 15A and the second supporting shaft 15B are engaged with the engaging grooves 27 from both sides of the switch main body 21, the door handle 9 can be more smoothly swung in the back-and-forth direction with respect to the door 3 of the vehicle and the operability of the door handle 9 can be enhanced.

Even in the case of a small door handle 9 of a small automobile, for example, even in the case of a small door handle 9 of a subcompact car, the above door handle device 1 can be easily fitted to the car. Therefore, the work can be simplified and the working time can be shortened.

Modification 1

The supporting shaft 15 of the first exemplary embodiment described above includes: the first supporting shaft 15A; and the second supporting shaft 15B. However, a change can be made in the constitution as follows. In this connection, portions in the Modification different from the supporting shaft 15 of the first exemplary embodiment described above will be mainly explained here.

FIG. 3 is a sectional view showing a door handle device of Modification 1. As shown in FIG. 3, the contact portion coming into contact with the supporting shaft 15 is provided on one side of the switch main body 21. In Modification 1, the contact portion composes an engaging groove 27 engaged with the supporting shaft 15.

One supporting shaft 15 is engaged with the engaging groove 27 provided on one side. In this connection, on the back side of the door handle 9, the insertion groove 31, into which the insertion protrusion 33 described later is inserted, is formed. In the mounting bracket 11, the insertion protrusion 33 is formed which is inserted into the insertion groove 31 while the insertion protrusion 33 is supporting the door handle 9 so that the door handle can be swung. Due to the foregoing, the switch unit 13 can be positively mounted on the mounting bracket 11 and the door handle 9 can be smoothly swung in the back-and-forth direction with respect to the door 3 of the vehicle. Accordingly, the operability of the door handle 9 can be ensured.

Modification 2

The contact portion of the first exemplary embodiment composes an engaging groove 27 engaged with the supporting shaft 15. However, it is possible to make a change as follows. In this connection, portions in the Modification different from the contact portion of the first exemplary embodiment described above will be mainly explained here.

Figure 4:
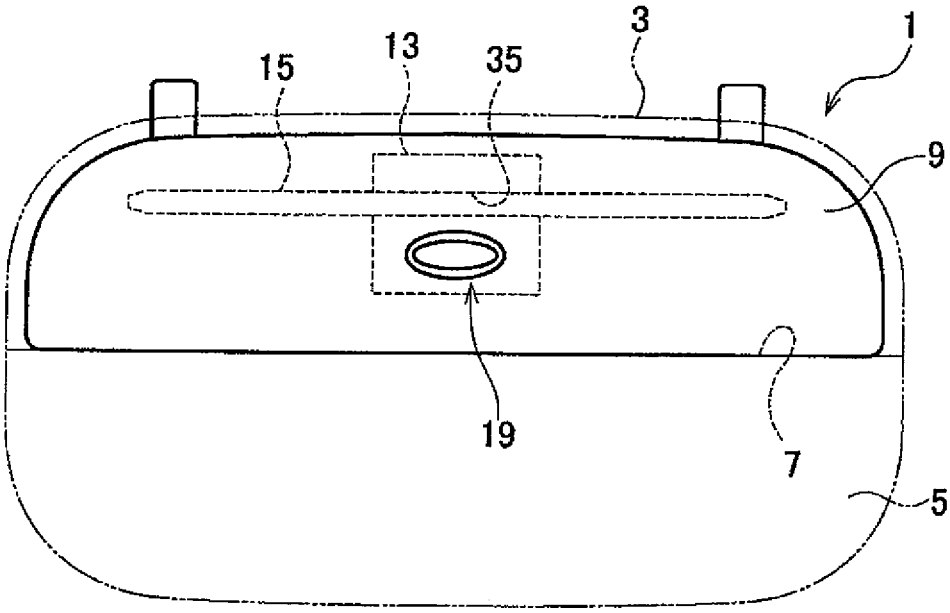
FIG. 4 is a front view showing a door handle device of Modification 2 of the first exemplary embodiment.

FIG. 4 is a front view showing a handle device of Modification 2. As shown in FIG. 4, a contact portion coming into contact with the supporting shaft 15 is provided in the switch main body 21. In Modification 2, the contact portion composes a through-hole 35 in which the supporting shaft 15 penetrates from one side to the other side in the switch main body 21. This through-hole 35 is formed on an upper side of the switch main body 21.

When one supporting shaft 15 penetrates in the through-hole 35, the switch unit 13 is fixed to the mounting bracket 11. Due to the foregoing, the switch unit 13 can be positively mounted on the mounting bracket 11 and the door handle 9 can be smoothly swung in the back-and-forth direction with respect to the door 3 of the vehicle. Accordingly, the operability of the door handle 9 can be ensured.

<Applicable Range of the Present Invention>

As described above, contents of the present invention are disclosed through the specific exemplary embodiments and the Modifications. However, it should be noted that the present invention is not limited by the descriptions and the drawings which constitute a portion of the disclosure.

For example, concerning the door 3 of the vehicle, the door handle device 1 may be fixed to each of the outer panels of the side doors located on both sides of the vehicle. Of course, the door handle device 1 may be fixed to an outer panel of a back door such as a door of a trunk room located at the rear of the vehicle.

From the disclosure of the present invention, Modifications, embodiments and techniques will be apparent for persons with an ordinary skill in the art. Accordingly, the technical range of the present invention is defined only by definitions in the appended claims.

Another Embodiment of the Present Invention

Figure 5A:
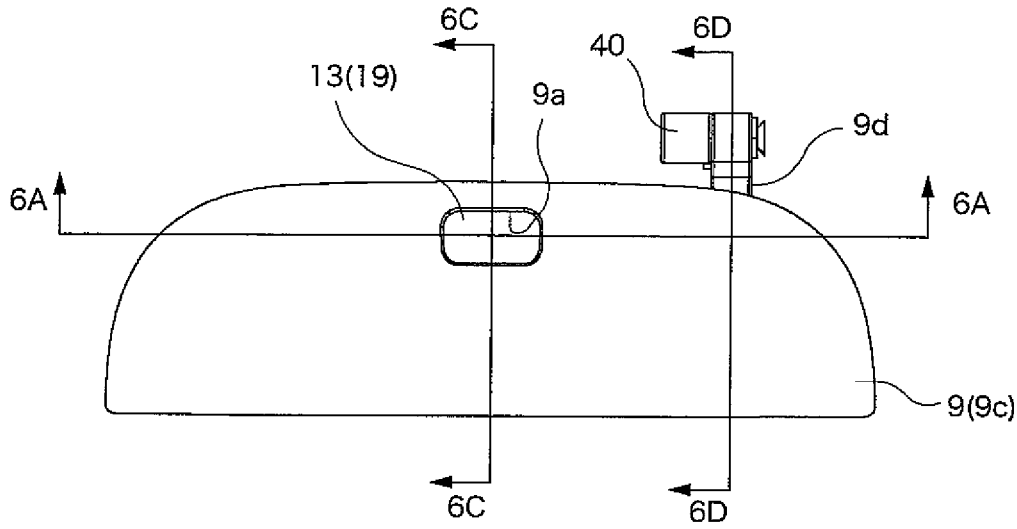
FIG. 5(*a*) is a front view of a door handle device of the second exemplary embodiment.
Figure 5B:
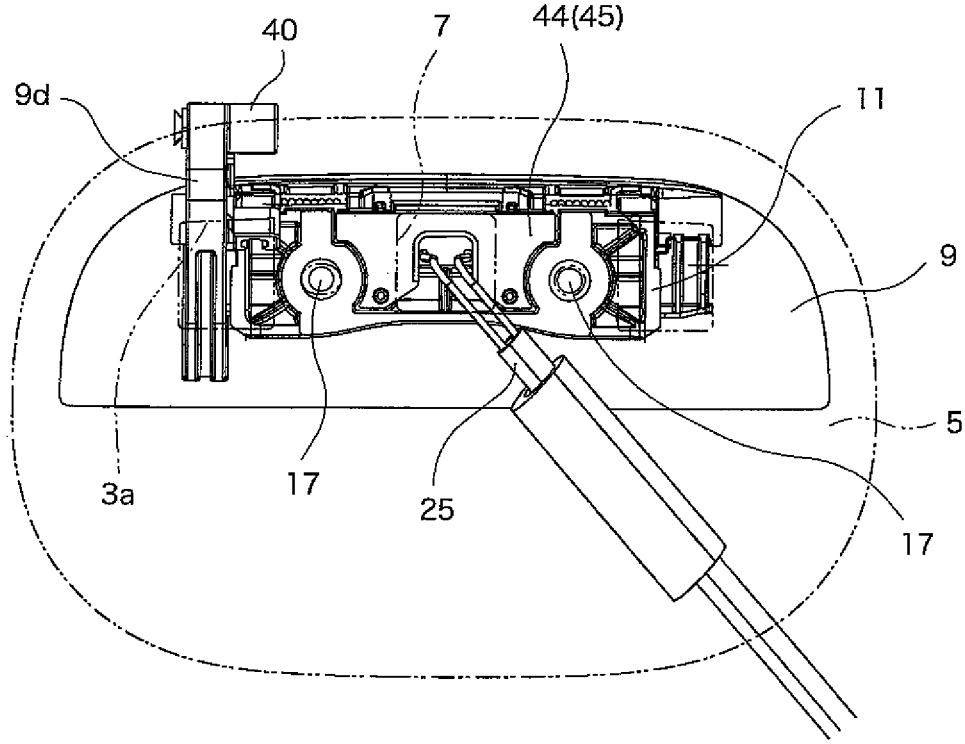

FIG. 5(*a*) and the following drawings show a second exemplary embodiment of the present invention. In this connection, in the following explanations, the same reference marks are used to indicate substantially the same components in the drawings of the first and the second exemplary embodiments. Further, when necessary, the detail of the components of the first exemplary embodiment described before will be additionally explained in the second exemplary embodiment here.

Figures 6A, 6B, 6C, 6D:
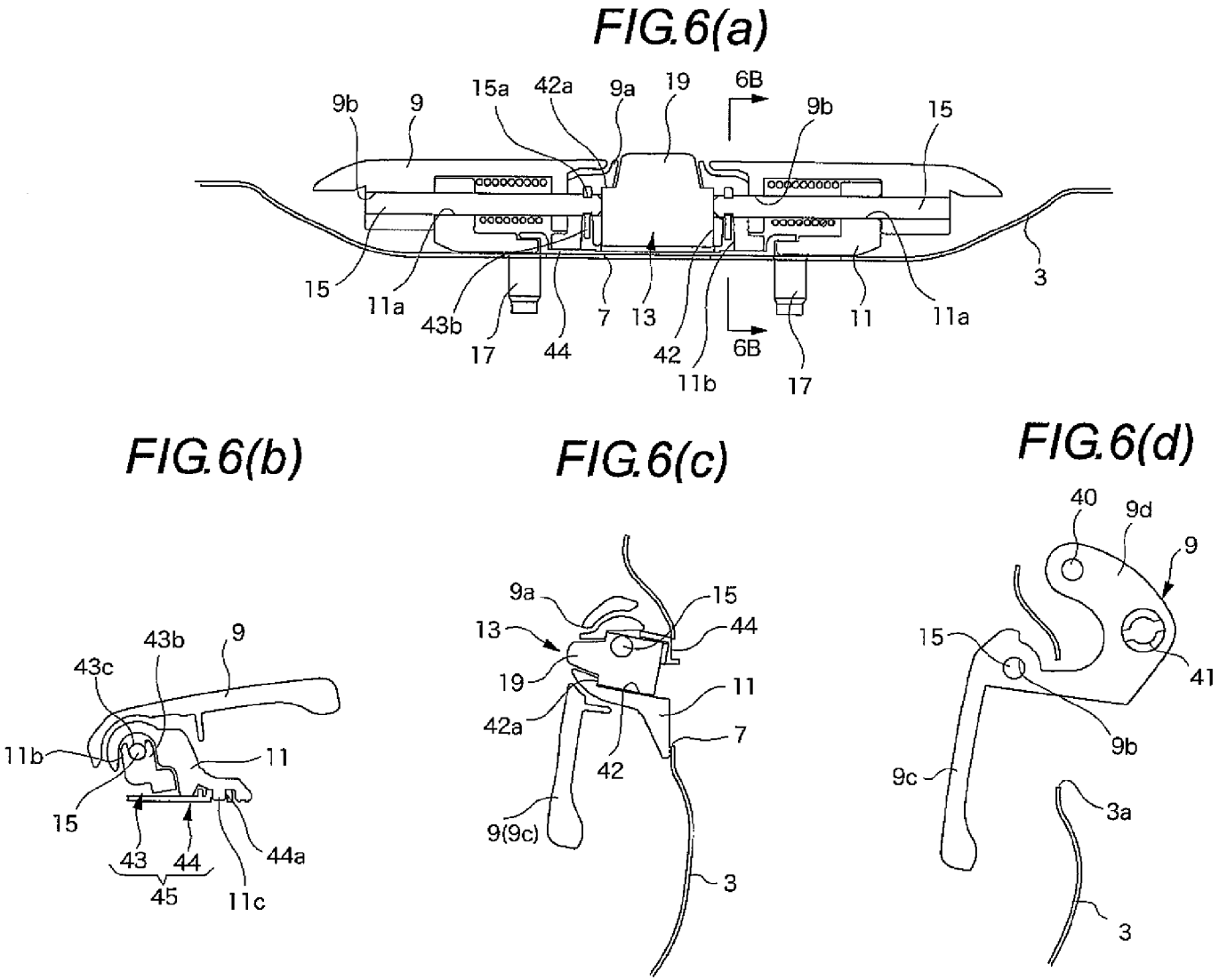
FIG. 6(*a*) is a sectional view taken on line 6A-6A in FIG. 5(*a*).

In the same manner as that of the first exemplary embodiment described before, the door handle device shown in FIGS. 5(*a*) and 5(*b*) is composed in such a manner that the door handle 9 is pivotally connected to the mounting bracket 11. The door handle 9 has an operation arm 9*d* protruding from a back face of the hand touching portion 9*c*. The counter weight 40 is fixed to the vicinity of the free end of the operation arm 9*d*. As shown in FIGS. 5(*b*) and 6(*c*), when the operation arm 9*d* is mounted on the door 3, this operation arm 9*d* is inserted from the arm insertion opening 3*a*, which is open onto the door 3, into the door 3. As shown in FIG. 6(*c*), the rod holder 41 is mounted on the operation arm 9*d*. When the operation arm 9*d* is mounted on the door 3, the operation arm 9*d* and the door lock device is connected to each other through a rod not shown connected to the rod holder 41.

In the same manner as that shown in FIG. 1, the switch exposure opening (the button hole 9*a*), which is formed in the door handle 9, is arranged in the vicinity of an upper edge of the hand touching portion and at the central position in the lateral direction (in the direction of the vehicle length). In FIG. 5(*a*), the operation arm 9*d* is formed on one of the right and the left. Therefore, the entire profile is asymmetrical in the lateral direction. However, as shown in FIG. 1, when the operation arm 9*d*, the profile of which is the same as that described above, is formed on the other side, all elements including the fixing member 17, are symmetrical in the lateral direction. Therefore, only when the mounting positions of the rod holder 41 and the counter weight 40 are changed, the handle device, the profile of which is different in the lateral direction, can be easily manufactured.

As shown in FIGS. 1 and 5(*b*), at the initial position where the door handle 9 is not given an operation force, the mounting bracket 11 to support the door handle 9 is formed by a size at a position so that the entire mounting bracket 11 can be covered by the door handle 9. As a result, when the door handle device is mounted on the door 3, it is possible to design the device so that only the door handle 9 can be exposed outside from the recess portion 5 of the door 3.

Figure 8:
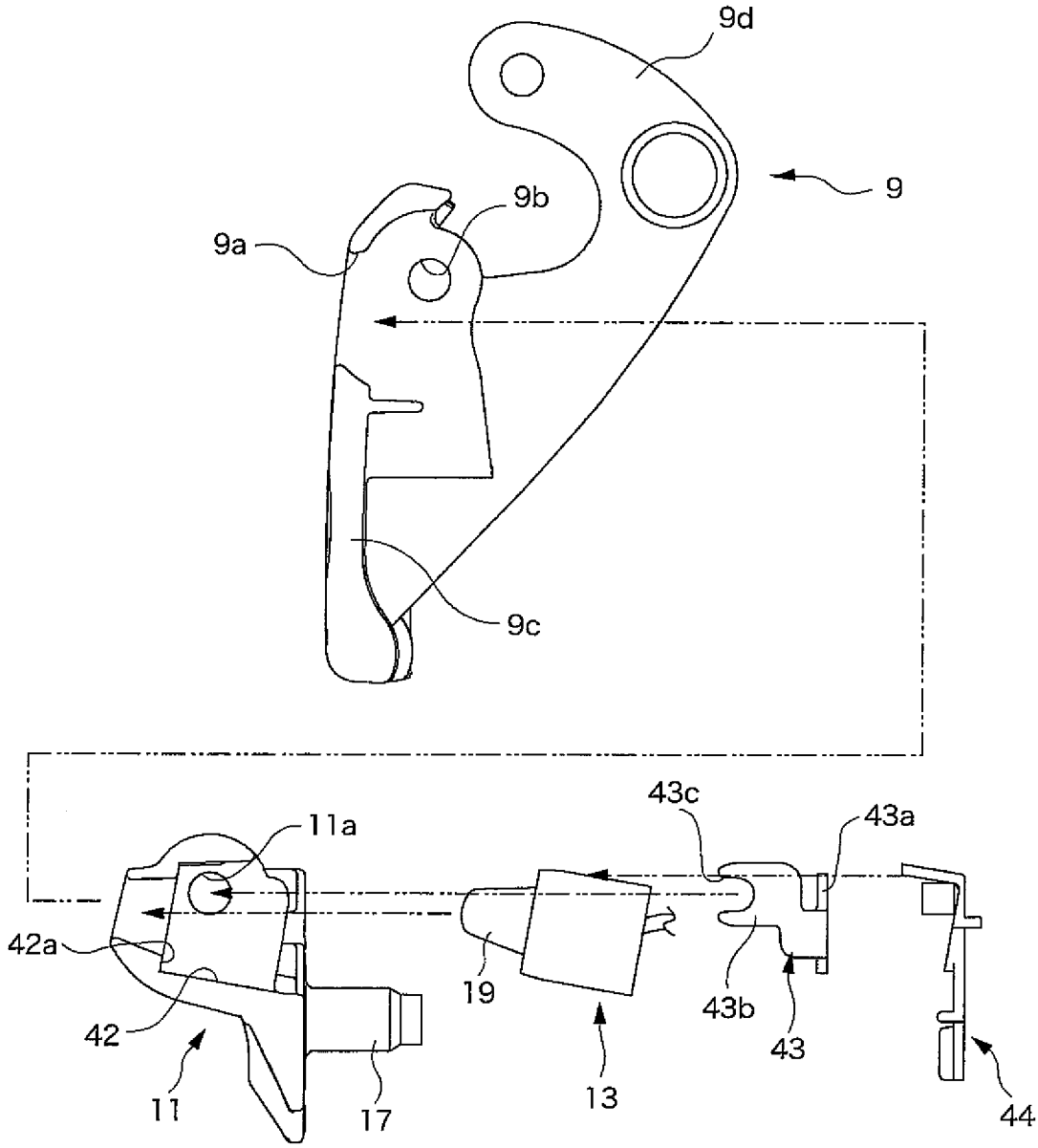
FIG. 8 is a sectional view of FIG. 7.

On the other hand, the switch unit 13 is held in the switch holding hole 42 formed in the mounting bracket 11. When the door handle 9 is located at the initial position, a forward end portion of the switch unit 13 is exposed from the switch exposure opening 9*a*. As shown in FIGS. 6 and 8, the switch unit 13 is inserted and fitted from a back side opening of the switch holding hole 42. When the switch unit 13 is made to come into contact with the inward flange 42*a*, which is formed in the switch holding hole 42, the switch unit 13 is prevented from coming out onto a front side.

In this connection, in the above explanations, a push button switch is used as the switch unit 13. However, it is possible to use a switch having no movable portion, for example, it is possible to use an electrostatic sensor switch. In this case, an electrode may be exposed from the switch exposure opening 9*a*.

In the same manner as that shown in FIG. 2, the switch mounting hole 7 open to the recess portion 5 of the door 3 is used as a drawing hole from which the harness 25 drawn out from the switch unit 13 is drawn into the door 3. Concerning this matter, refer to FIG. 5(*b*). As shown in FIGS. 2 and 6(*a*), the switch unit 13 is formed so that the lateral width (the width in the vehicle length direction) can be a little larger than the size of the switch mounting hole 7. As a result, the switch unit 13 is prevented from coming out onto the surface side by the inward flange 42*a*. The switch unit 13 is also prevented from coming out onto the back side by the door 3. Accordingly, the switch unit 13 can be held at a predetermined position. At the same time, when the switch unit 13 is pushed down, it can be effectively prevented from becoming rickety.

As described above, when the handle device is fixed to the door 3, the switch unit 13 is prevented from being disconnected. Accordingly, it is unnecessary that the mounting bracket 11 holds the handle device by a high mechanical strength of holding.

In the second exemplary embodiment, attention is paid to this point. After the switch unit 13 has been inserted into the switch holding hole 42, a back face opening of the switch holding hole 42 is temporarily closed, so that the switch unit 13 can be temporarily held until the fixing work to the door 3 is completed.

Figure 7:
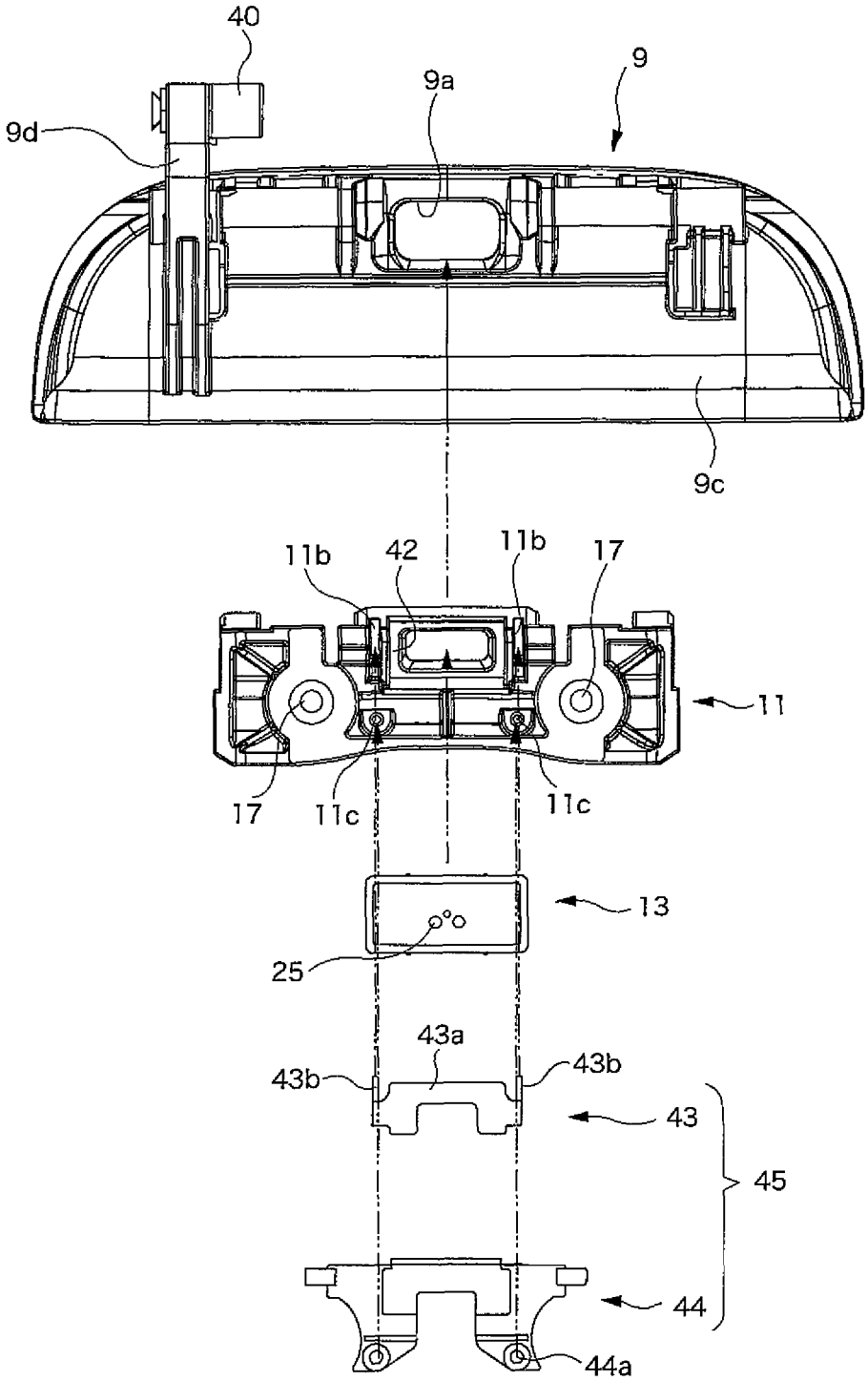
FIG. 7 is an exploded view showing a primary portion of FIG. 5.

As shown in FIG. 6(*b*), in order to close the switch holding hole 42, the shaft fixing member 45, which is formed out of the hinge receiving member 43 and the sheet member 44, is used. As shown in FIGS. 7 and 8, the hinge receiving member 43 is formed out of a metallic sheet member and provided with a hinge piece 43*b* bent at both end portions on the right and the left of the base portion 43*a*. The hinge piece 43*b* is provided with a U-shaped cutout 43*c*, which is formed at the forward end portion, and inserted into a receiving recess portion 11*b* formed in the mounting bracket 11.

On the other hand, in the supporting shaft 15, the slit 15*a* for preventing the supporting shaft 15 from slipping off, which is capable of engaging with the cutout 43*c*, is formed. Therefore, only when the hinge piece 43*b* is inserted into the receiving recess portion 11*b* under the condition that the supporting shaft 15 is inserted into the handle shaft insertion hole 9*b* of the door handle 9 and the bracket shaft insertion hole 11*a* of the mounting bracket 11, the cutout 43*c* is engaged with the slit 15*a* for preventing the supporting shaft 15 from slipping off. Therefore, the supporting shaft 15 can be prevented from coming out from the mounting bracket 11.

The sheet member 44 is made of synthetic resin and interposed between the hinge receiving member 43 and the door 3. This sheet member 44 prevents the hinge receiving member 43 made of metallic material from directly coming into contact with the door 3. When the engaging hole 44*a* is press-fitted to the engaging protruding portion 11*c* of the mounting bracket 11, this sheet member 44 is mounted on the mounting bracket. Therefore, in the state of mounting in which the handle device is fixed to the door 3, the switch unit 13 and the hinge receiving member 43 are temporarily held so as to prevent the components from coming out.

In this connection, in the structure described above, the member 45 for preventing the shaft from slipping off is formed out of two parts including the hinge receiving member 43 and the sheet member 44. However, it is possible to form the entire member 45 for preventing the shaft from slipping off as an injection molding of synthetic resin.

As shown in FIGS. 1 and 5(*b*), at the initial position where the door handle 9 is not given an operation force, the mounting bracket 11 composed as described above is formed by a size at a position so that the entire mounting bracket 11 can be covered by the door handle 9. As a result, when the door handle device is mounted on the door 3, it is possible to design the device so that only the door handle 9 can be exposed outside from the recess portion 5 of the door 3.

The present application is based on the Japanese Patent Application (Patent Application No. 2007-057671) filed on Mar. 7, 2007 and the Japanese Patent Application (Patent Application No. 2008-021180) filed on Jan. 31, 2008 and the contents of which are incorporated herein by reference.

INDUSTRIAL APPLICABILITY

The present invention can be used as a door handle device of a vehicle.

The invention claimed is:

1. A door handle device comprising:

a door handle for opening and closing a door of a vehicle, wherein the door handle is arranged outside the door of the vehicle, and a handle shaft insertion hole into which a supporting shaft is inserted is formed on a reverse side of the door handle;

a mounting bracket for supporting the door handle so that the door handle can be swung in a back-and-forth direction with respect to the door of the vehicle, wherein the mounting bracket is fixed to the door of the vehicle, and a bracket shaft insertion hole into which the supporting shaft is inserted is formed on the mounting bracket; and a switch unit for generating an electric signal for locking and unlocking a door lock provided in the door of the vehicle, wherein the switch unit is arranged between the door handle and the mounting bracket, wherein the switch unit includes a direct contact portion to which the supporting shaft comes into contact and supports the switch unit, and wherein the supporting shaft is inserted through the handle shaft insertion hole and the bracket shaft insertion hole, and the supporting shaft fixes the switch unit to the mounting bracket at the contact portion.

2. The door handle device according to claim 1, wherein the switch unit includes a push button which is exposed outside the vehicle and displaced by a physical input from the outside of the vehicle and also includes a switch main body which generates an electric signal according to a displacement of the push button, wherein the contact portion comprises an engaging groove which is arranged on a side of the switch main body and engaged with the supporting shaft, and wherein the switch unit is fixed to the mounting bracket by engaging the supporting shaft in the engaging groove.

3. The door handle device according to claim 2, wherein the engaging groove comprises two engaging grooves provided on both sides of the switch main body, and wherein the supporting shaft includes a first supporting shaft engaging with one of the engaging grooves and a second supporting shaft engaging with the other of the engaging grooves.

4. The door handle device according to claim 1, wherein the switch unit includes a push button which is exposed outside the vehicle and displaced by a physical input from the outside of the vehicle and also includes a switch main body which generates an electric signal according to a displacement of the push button, wherein the contact portion comprises a through-hole into which the supporting shaft penetrates from one side of the switch main body to the other side, and wherein the switch unit is fixed to the mounting bracket by penetrating the supporting shaft in the through-hole.

5. The door handle device according to claim 1, wherein the switch unit is inserted into a switch holding hole which is provided in the mounting bracket and includes an inward flange at a front end portion used for preventing the switch unit from slipping off, and a back face portion of the switch unit is supported and fixed onto a door surface under a condition that the switch unit is fixed to the door.

6. The door handle device according to claim 5, wherein a member for preventing the shaft from coming out, in which a hinge piece inserted inside the switch holding hole is protruded from a supporting piece supported on a door surface along a back face wall of the switch unit under the condition that the switch unit is fixed to the door, is temporarily fitted in the switch holding hole, and wherein the supporting shaft is prevented from slipping off by inserting the hinge piece of the member for preventing the shaft from coming out into a slit for preventing the hinge piece from coming out which is formed in the supporting shaft.

7. A door handle device comprising:

a mounting bracket fixed on a door of a vehicle;

a door handle pivotally connected to the mounting bracket; and a switch exposure opening which is provided in the door handle and exposes an operation portion of a switch unit having a direct contact portion which directly contacts the mounting bracket and is supported by the mounting bracket and generates an electric signal for locking and unlocking a door lock provided on a door of a vehicle.

8. The door handle device according to claim 7, wherein the mounting bracket is covered behind the door handle under the condition that the door handle device is fixed to the door.

9. The door handle device according to claim 7, wherein the door handle is pivotally connected to the mounting bracket in a vicinity of an upper edge of the mounting bracket so that the door handle can be freely rotated in a vertical direction, and wherein the switch exposure opening is arranged at a position substantially overlapping on a rotary center of the door handle in a front view at an initial rotary position.

10. The door handle device according to claim 7, wherein the switch exposure opening is arranged at a substantially central position in a longitudinal direction of the door handle.

* * * * *